US010308422B2

(12) United States Patent
Popall

(10) Patent No.: US 10,308,422 B2
(45) Date of Patent: Jun. 4, 2019

(54) FOLDABLE RCS CONTAINER

(71) Applicants: THYSSENKRUPP MARINE SYSTEMS GMBH, Kiel (DE); thyssenkrupp AG, Essen (DE)

(72) Inventor: Christian Popall, Ellerau (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/550,707

(22) PCT Filed: Jan. 26, 2016

(86) PCT No.: PCT/EP2016/051494
§ 371 (c)(1),
(2) Date: Aug. 11, 2017

(87) PCT Pub. No.: WO2016/128208
PCT Pub. Date: Aug. 18, 2016

(65) Prior Publication Data

US 2018/0029792 A1 Feb. 1, 2018

(30) Foreign Application Priority Data

Feb. 12, 2015 (DE) ..... 10 2015 202 551

(51) Int. Cl.
*B65D 88/52* (2006.01)
*B65D 90/02* (2019.01)
(Continued)

(52) U.S. Cl.
CPC ..... *B65D 88/524* (2013.01); *B65D 90/008* (2013.01); *B65D 90/022* (2013.01); *B65D 90/325* (2013.01)

(58) Field of Classification Search
CPC .... B65D 88/524; B65D 88/522; B65D 88/52; B65D 81/3823; B65D 81/18; B65D 1/40;
(Continued)

(56) References Cited

U.S. PATENT DOCUMENTS 1,910,703 A * 5/1933 Le Grand ..... E04B 1/7654 217/128
2,036,429 A * 4/1936 Moody ..... F25D 23/06 217/128

(Continued)

FOREIGN PATENT DOCUMENTS

DE 1536121 A 11/1969
DE 1956979 A 7/1971

(Continued)

OTHER PUBLICATIONS

International Standard, "Series 1 Freight Containers—Classification, Dimensions, and Ratings", ISO, Aug. 1, 2013, Table 1.*

(Continued)

*Primary Examiner* — Robert J Hicks
(74) *Attorney, Agent, or Firm* — thyssenkrupp North America, Inc.

(57) ABSTRACT

A container may have a floor, a ceiling, a first side wall, and a second side wall, a first end wall, and a second end wall. The first side wall, the second side wall, the first end wall, and the second end wall may be formed from a container wall for reducing an effective radar cross section of the container. The first side wall and the second side wall in a longitudinal direction of the container mid-height between the floor and the ceiling may be foldable inward into the interior of the container. The first side wall may include a first cladding board that is permeable to radar rays and reduces the effective radar cross section of the container. The first cladding board may have a reflective agent that reflects (Continued)

radar rays and can be aligned to be at least partially inclined relative to a plane of a main extent of the first cladding board.

15 Claims, 3 Drawing Sheets

(51) Int. Cl.
*B65D 90/32* (2006.01)
*B65D 90/00* (2006.01)

(58) Field of Classification Search
CPC .... B65D 90/008; B65D 90/022; B65D 90/02; B65D 90/325; B65D 90/22; B65D 11/184; B65D 11/1853; B65D 11/1846; B65D 11/1833
USPC .... 220/1.5, 6, 592.21, 592.26, 592.2, 62.17, 220/62.15, 62.11, 560.02, 560.01, DIG. 9; 206/524.2
See application file for complete search history.

(56) References Cited

U.S. PATENT DOCUMENTS 2,556,418 A * 6/1951 Del Mar ..... B65D 19/38 220/1.5
2,746,892 A * 5/1956 Elfving ..... B29C 70/00 220/592.21
2,972,430 A 2/1961 Johnson
3,294,272 A * 12/1966 Nagler ..... B64D 1/16 156/155
3,398,850 A 8/1968 Kennard
3,481,503 A * 12/1969 Kloess ..... B65D 88/126 220/1.5
3,519,529 A * 7/1970 Cook ..... B60K 15/03177 109/80
4,538,663 A * 9/1985 Looker ..... B65D 90/021 160/368.1
4,581,285 A * 4/1986 Mahefkey, Jr. ..... B32B 15/08 442/378
4,708,757 A * 11/1987 Guthrie ..... B32B 37/144 156/163
4,953,922 A * 9/1990 Granqvist ..... F41H 3/00 2/900
5,288,538 A * 2/1994 Spears ..... B29C 44/1228 428/116
5,788,110 A * 8/1998 Alhamad ..... A62C 3/0257 342/4
6,613,420 B1 * 9/2003 Leupolz ..... F41H 3/00 428/212
6,738,007 B1 * 5/2004 Stafford ..... B63G 13/02 342/3
7,271,759 B1 * 9/2007 Bofinger ..... F41H 3/00 342/3
7,366,472 B2 * 4/2008 Messano ..... H01Q 1/526 174/377
2006/0081628 A1 4/2006 D Myers
2010/0147842 A1 * 6/2010 Reynard ..... B65D 88/022 220/23.88
2012/0006816 A1 1/2012 Turnquist
2017/0088243 A1 3/2017 Ewers et al.

FOREIGN PATENT DOCUMENTS

DE 3408132 A 10/1985
DE 20111561 U 12/2001
DE 102014103601 A 9/2015
GB 1326909 A 8/1973
WO 0109562 A 2/2001
WO 2010085785 A 7/2010
WO 2011154982 A 12/2011

OTHER PUBLICATIONS

English Translation of International Search Report issued in PCT/EP2016/051494, dated Mar. 24, 2016 (dated Apr. 19, 2016).
English machine translation of Abstract for DE20111561.

* cited by examiner

FOLDABLE RCS CONTAINER

CROSS REFERENCE TO RELATED APPLICATIONS

This application is a U.S. National Stage Entry of International Patent Application Serial Number PCT/EP2016/051494, filed Jan. 26, 2016, which claims priority to German Patent Application No. DE 10 2015 202 551.9 filed Feb. 12, 2015, the entire contents of both of which are incorporated herein by reference.

FIELD

The present disclosure generally relates to containers, including containers in which sides are formed from a container wall for reducing an effective radar cross section.

BACKGROUND

Standard containers have established themselves for storing and transporting goods. In the meantime, said standard containers are also being used in a very much wider spectrum, from temporary residential buildings or offices to mobile operating rooms.

ISO 668 standardizes containers for maritime freight. However, this standard today is used far beyond maritime freight, such that these containers have become accepted as the standard also in the rail and truck sectors. The 20 ft and 40 ft containers are most commonly found, but the standard also defines containers with a length of 45 ft or 53 ft. On account of the wide use of these containers, the infrastructure in the logistics sector has also been adapted to said containers. Loading bays or storage spaces are typically designed for these standard containers.

In order to save space when containers are not being used, it is known from the prior art for said containers to be folded. A foldable standard container is known from DE 201 11 561 U1, wherein four post elements are movable between a vertical and a horizontal position. A self-unfolding standard container is known from WO 2011/154982 A1.

A foldable maritime container is known from WO 2010 085 785 A2.

A folding box-shaped unit is known from DE 1 536 121 A.

A method for coating surfaces for the purpose of camouflaging them in relation to radar is known from DE 1 956 979 C3.

Despite the above, non-foldable containers are mainly used today, since these are substantially more cost-effective and maintenance free. Likewise, the storage and transportation of empty containers is comparatively problem-free since modern container vessels can transport up to 19 000 20-ft containers (TEU: twenty-foot equivalent unit).

Standard containers are also increasingly establishing themselves in the defense sector since the former by virtue of their standardization are comparatively easy to handle. However, it is disadvantageous that the standardized containers by virtue of the vertical metallic side walls thereof have a comparatively large radar cross section when stowed on the ship's deck, and a vessel which transports such containers is thus easy to detect and thus to render vulnerable. For this reason, containers have also been optimized for the defense sector while considering the effective radar cross section. By way of example, a standard container which has a minimized effective radar cross section (RCS) is known from the post-published DE 10 2014 103 601.

However, it is often desirable in the defense sector for not only the radar signature but also the visibility to be reduced. While it is indeed known for these standard containers to be provided for example with camouflage paint, this can only represent a limited improvement. Moreover, the incoming and outgoing transportation of material that is no longer required, even of a standard container that is no longer being used, is typically very complex in the defense sector.

Therefore a need exists for a container that is optimized for application in the defense sector, said container minimizing the ability for detection and being employable in a reliable manner in the field.

DETAILED DESCRIPTION

Figure 1:
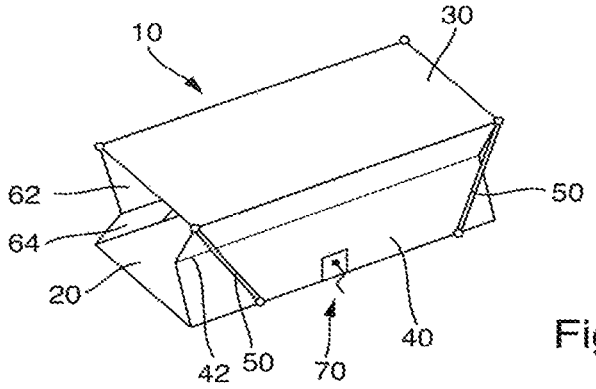
FIG. 1 is a schematic perspective view of an example container during folding.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The container according to the invention has a floor, a ceiling, a first side wall and a second side wall, a first end wall and a second end wall. The container in the unfolded state is substantially cuboid. The first side wall, the second side wall, the first end wall and the second end wall are formed from a container wall for reducing the effective radar cross section. A container wall is configured for reducing the effective radar cross section when said container wall is configured either for the absorption of radar radiation and/or for the reflection of incident radar radiation at an angle that is dissimilar to the incident angle. In the case of the container wall being configured for the reflection of incident radar radiation at an angle that is dissimilar to the incident angle, said container wall is usually conceived for the reflection of an incident radar ray at an oblique angle, usually at 15°±3°, in relation to the surface of the earth. This corresponds to the most probable threat scenario. The first side wall and the second side wall in the longitudinal direction of the container, mid-height between the floor and the ceiling, are foldable inward into the interior of the container. At least the first side wall has a first cladding board for reducing the effective radar cross section. The first cladding board is permeable to radar rays. The first cladding board furthermore has a reflective agent which reflects radar rays. The reflective agent is embedded in the first cladding board and is aligned so as to be at least partially inclined in relation to a plane of main extent of the first cladding board.

Since the reflective agent is internal and thus integrated in the cladding board, wear for example by abrasion, is avoided. The reduction of the effective radar cross section is thus preserved even in the case of the container being regularly folded.

In one further embodiment of the invention, the second side wall has a second cladding board for reducing the effective radar cross section. The second cladding board is permeable to radar rays. The second cladding board furthermore has a reflective agent which reflects radar rays. The reflective agent is embedded in the second cladding board and is aligned so as to be at least partially inclined in relation to a plane of main extent of the second cladding board.

In one further embodiment of the invention, the first end wall has a third cladding board for reducing the effective radar cross section. The third cladding board is permeable to radar rays. The third cladding board furthermore has a reflective agent which reflects radar rays. The reflective agent is embedded in the third cladding board and is aligned so as to be at least partially inclined in relation to a plane of main extent of the third cladding board.

In one further embodiment of the invention, the second end wall has a fourth cladding board for reducing the effective radar cross section. The fourth cladding board is permeable to radar rays. The fourth cladding board furthermore has a reflective agent which reflects radar rays. The reflective agent is embedded in the fourth cladding board and is aligned so as to be at least partially inclined in relation to a plane of main extent of the forth cladding board.

The embodiment of a cladding board is described for example in DE 10 2014 103 601 A1, the latter being fully incorporated herein by reference.

In one embodiment of the invention, the ceiling is also formed from a container wall for reducing the effective radar cross section.

In one further embodiment of the invention, at least the first end wall has a first door. The first door of the first end wall is embodied so as to be double-leafed, having a first door leaf and a second door leaf. The first door is foldable inward in the interior of the container. The first door leaf is embodied in two parts, having a first upper door leaf and a first lower door leaf. The second door leaf is embodied in two parts, having a second upper door leaf and a second lower door leaf. The first upper door leaf, the first lower door leaf, the second upper door leaf, and the second lower door leaf extend across half the height between the floor and the ceiling. The first upper door leaf and the first lower door leaf, and the second upper door leaf and the second lower door leaf, can be connectable. It is an advantage of this embodiment that the container can be tightly closed on account thereof.

The unfolded state of the container can be referred to as the receiving position, while the folded state can be referred to as the storage position.

In one preferred embodiment, the first door of the first end wall is not only foldable inward into the interior of the container, but can also be opened outward. The first door can preferably be opened outward by at least 90°, more preferably be opened outward by at least 180°, and particularly preferably be opened outward by 270°.

In one further embodiment of the invention, the second end wall also has a second door which is configured like the first door. Alternatively, the second end wall can be embodied so as to be foldable such that the second end wall is foldable inward into the interior of the container, toward the ceiling or the floor.

In one further embodiment of the invention, the container has post elements, wherein the post elements in the unfolded state connect the ceiling and the floor in a force-fitting manner, wherein the post elements in the unfolded state are disposed on the edges of the cuboid. The post elements are preferably embodied so as to be rigid, thus stabilizing the container in the unfolded state. The post elements are preferably in each case connected in a foldable manner by way of a twistlock. Twistlocks according to ISO 668 are connection elements of standard containers that are located in the corners of the cuboid. In one embodiment, the post elements are in each case connected in a foldable manner with the twistlock that is located on the floor.

This is preferable when the container is erected and taken down by hand. In another embodiment, the post elements are in each case connected to the twistlock that is located on the ceiling. This embodiment is preferable when the post elements on that side that faces the floor are connected to the floor by way of a movable element, for example a rack, a threaded spindle, or a rail.

In one further embodiment of the invention, the post elements by way of at least two rotatable connection elements are connected to threaded spindles and by way of the threaded spindles to the floor in such a manner that the post elements by rotating the threaded spindles can be aligned so as to be parallel with the floor. A threaded spindle has an encircling trapezoidal thread, for example. On account thereof, a component having an internal thread that sits around the threaded spindle can be displaced along the threaded spindle like on a screw. In one embodiment, the container has four threaded spindles, wherein each post element is connected to one threaded spindle. In one alternative embodiment, the container has two threaded spindles, wherein two post elements are connected to each threaded spindle. The threaded spindle in this embodiment has a first and a second region, wherein a first post element is connected in the one first region, and a second post element is connected in the one second region, wherein the direction of rotation of the trapezoidal thread of the threaded spindle in the two regions is counter-rotating. On account thereof, two post elements of one side can be simultaneously folded by way of a single threaded spindle. It is ensured on account thereof that shearing forces do not arise in the folding of the container.

In one further embodiment of the invention, the threaded spindles are driven manually, electrically, hydraulically, or pneumatically. Particularly preferably, the threaded spindles can be driven manually, on the one hand, and electrically, hydraulically, or pneumatically, on the other hand. On account thereof, a container in a field camp, for example, can be unfolded or folded even without any technical auxiliary equipment.

In one further embodiment of the invention, the container is a container according to ISO 668, particularly preferably a 20-ft container according to ISO 668.

In one further embodiment of the invention, the container is secured in terms of ballistics. A ballistic protection can be established for example by attaching Kevlar to the inside or the outside. On account thereof, the interior is protected from minor projectiles or shrapnel. This embodiment is preferable when the container is to serve as a working space, for example in a field camp.

The preferred container wall has the advantage that the reflective agent is integrated in the cladding board such that the surface of the cladding board does not comprise any regions with an alignment that is inclined in relation to the plane of main extent. In this way, the container can be embodied so as to conform to ISO 668, and the radar cross section (RCS) can be simultaneously reduced since the radar-reflecting part in relation to the plane of main extent is partially inclined and the incident radar rays thus are not reflected directly back to the emitter of the radar waves. In other words, the reflective agent is configured in particular in such a manner that incident radar rays that impact the reflective agent along a direction of incidence that is substantially perpendicular to the plane of main extent are reflected by the reflective agent in an outgoing direction that deviates from the antiparallel direction of incidence. Vectors which are parallel but have an opposite direction are understood to be antiparallel. The integration of the reflective agent in the cladding board moreover has the advantage that the container wall can be produced in a simple manner.

According to one preferred embodiment of the container wall it is provided that the reflective agent has a sawtooth profile. On account of the sawtooth profile, a reflective agent in which the reflective faces are at all times inclined in relation to the plane of main extent, and thus a reflection of incident radar rays directly back to the emitter is suppressed, can be provided in a particularly efficient manner. It is simultaneously prevented by the sawtooth profile that the thickness of the reflective agent perpendicular to the plane of main extent becomes excessive, thus impeding the assembly. The sawtooth profile is preferably implemented in that the reflective agent is constructed from a plurality of first and second reflective inclines which are disposed in an alternating manner along a direction of main extent of the reflective agent.

According to one preferred embodiment of the container wall, it is provided that in each case a first angle is configured between the plane of main extent and the first reflective incline, and in each case a second angle is configured between the plane of main extent and the second reflective incline, wherein the first angle and the second angle are dissimilar, and wherein in particular the first angle is smaller than the second angle. Advantageously, the first and the second reflective inclines are thus inclined dissimilarly in relation to the plane of main extent. It is conceivable that the first angle is between 5° and 60°, particularly preferably between 10° and 30°, most particularly preferably between 15° and 25°, and/or that the second angle is between 60° and 100°, particularly preferably between 70° and 90°, most particularly preferably is substantially 85°.

According to one preferred embodiment of the container wall, it is provided that the cladding board comprises a substantially rigid sandwich board. Advantageously, the container wall is thus comparatively light and can be produced in a cost-effective manner. The sandwich board preferably has two cover layers and a core that is disposed between the two cover layers. The cover layers in each case preferably comprise a glass-fiber reinforced plastics material, while the core preferably comprises a foam core. The reflective agent is embedded in the core in particular.

According to one preferred embodiment of the container wall, it is provided that the reflective agent comprises a conductive film/foil. For example, it is conceivable that the reflective agent comprises a metal insert, a woven fabric, and/or a carbon-fiber reinforced plastics-material insert. Advantageously, a high coefficient of reflection of the reflective agent is thus achieved, on the one hand, and a cost-effective and simple production, on the other hand.

According to one embodiment of the container wall, the container wall is composed of a structural wall that is not configured for reducing the effective radar cross section (RCS), for example of a metallic wall to which cladding boards which are configured for reducing the effective radar cross section (RCS) are applied. The cladding board herein is preferably configured such as has been described in the context of the container wall which is configured for reducing the effective radar cross section (RCS). This embodiment is preferable for retrofitting foldable containers which are not optimized in terms of RCS.

In one further embodiment of the invention, the RCS wall parts on account of the construction of the latter, in particular of the sandwich construction, are resistant to sea wash. The frame construction is preferably conceived such that said frame construction can absorb the forces caused by sea wash on the RCS wall parts. The movable and non-movable parts of the frame construction are preferably made from high-tensile, high-alloy steel types, so as to correspond to the stresses to be expected, said steel types without any further reinforcement elements directing the forces by way of the twistlock elements into the structure of the vessel. In the case of extreme conditions that are to be potentially expected, the RCS container, like the normal standard container, can additionally also be lashed at the upper twistlock elements.

In one further embodiment of the invention, the container has a seal. To this end, the container can have rubber seals of various embodiments which seal the container in the locked state in a wind and water-tight manner, preferably according to protection class IP23.

The container 10 shown in FIG. 1 to FIG. 4 is a 20-ft container according to ISO 668. The container has the usual features of a standard container, in particular the standardized container corners for locking the container.

The container 10 in FIG. 1 is shown while the container is being unfolded. The container 10 has a floor 20 and a ceiling 30 and two side walls 40. The side walls 40, mid-height between the floor 20 and the ceiling 30, are foldable inward into the interior of the container 10 by means of a folding joint 42. The container 10 has post elements 50 for stabilizing the container 10 in the unfolded state. These post elements 50 are connected in a foldable manner to the container corners on the ceiling 30. The post elements 50 are connected to the floor 20 by way of threaded spindles 80 (shown in FIG. 4). On account thereof, the post elements 50 by rotating the threaded spindles 80 can be aligned so as to be parallel with the floor 20. The drive of the threaded spindles 80 is established by way of the crank 70. The container 10 on the first end wall has a double-leafed door which is composed of two upper door leaves 62 and two lower door leaves 64. The upper door leaves 62 and the lower door leaves 64 are folded inward into the interior of the container 10 and come to bear on the side walls 40. On account thereof, the container 10 can be completely folded in a compact manner.

Figure 2:
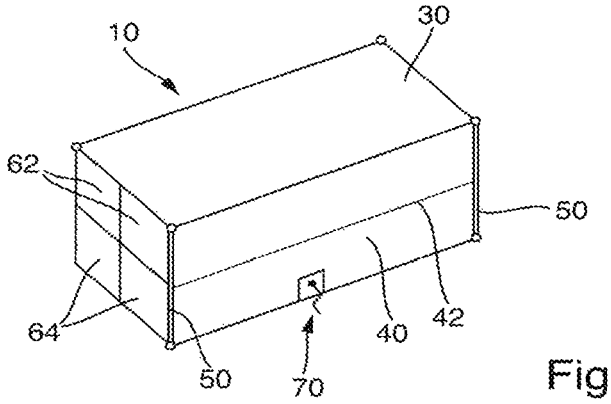
FIG. 2 is a schematic perspective view of an example container in an unfolded state.

The container 10 in FIG. 2 is shown so as to be unfolded, the door on the first end wall is closed, the post elements 50 are vertical and connect the floor 20 and the ceiling 30 in a force-fitting manner. The crank 70 is preferably removable in order for the container 10 to have external dimensions according to ISO 668 and to be stackable and transportable in a corresponding manner.

Figure 3:
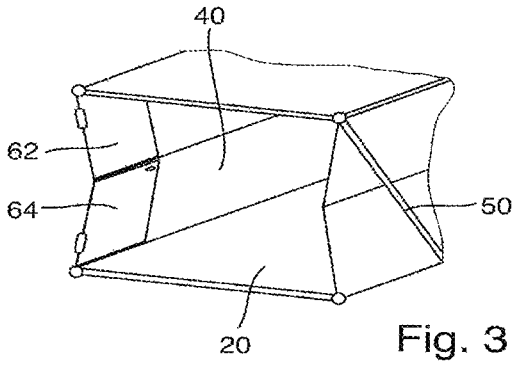
FIG. 3 is a schematic view of a first end side of an example container during folding.

The container 10 in FIG. 3 is in a perspective front view. As opposed to FIG. 1, it can be more readily seen how the upper door leaf 62 and the lower door leaf 64 are folded inward into the interior of the container 10 so as to be against the side wall 40.

Figure 4:
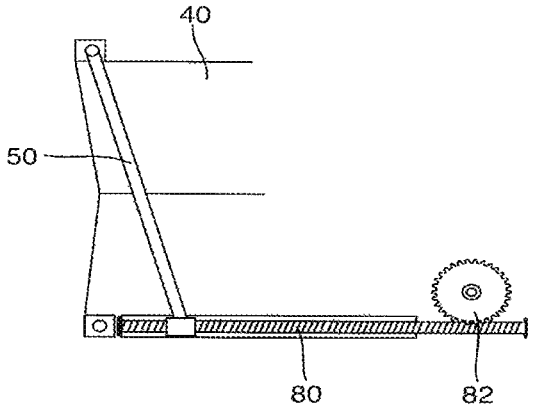
FIG. 4 is a schematic view of an example folding mechanism.

FIG. 4 schematically shows the mechanism of the container 10. The standardized container corners for locking the container can be seen at the corners of the cuboid. In order for the container 10 to be unfolded or folded, the post element 50 by rotation of the threaded spindle 80, the latter being rotated by way of the drive 82, is moved to a position that is parallel with the floor 20 or to a vertical position. The drive 82 is preferably drivable both by means of the crank 70 shown in FIG. 1 as well as by electric means.

Figure 5:
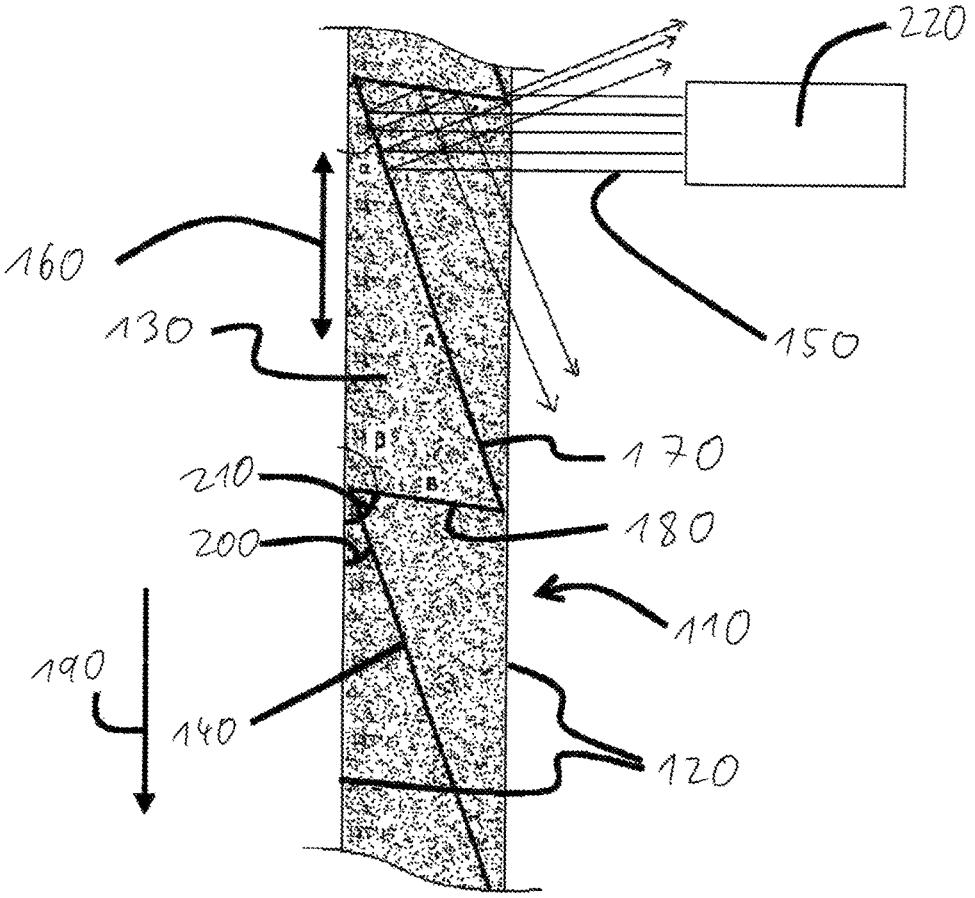
FIG. 5 is a schematic view of an example cladding board.

A schematic sectional view of a cladding board 110 for reducing the effective radar cross section is illustrated in FIG. 5. The cladding board 110 is configured in the form of a rigid or semi-rigid sandwich board. To this end, the cladding board 110 comprises two cover layers 120 from a glass-fiber reinforced plastics material (GRP) and a core 130 which is disposed between the two cover layers 120. The core 130 comprises a foam core, preferably a polyurethane foam (PUR). A high load capacity and a high rigidity and at the same time a very low weight result on account of the composite of the cover layers 120 and the foam core. Moreover, the cladding board 110 is permeable to radar rays 150, such that no noteworthy radar echo emanates from the planar surface of the cladding board 110 which extends along a plane of main extent 160. The cladding board 110 furthermore has a reflective agent 140 which is integrated in or adhesively bonded into the foam core, respectively. The reflective agent 140 is configured in the form of a metal insert, on account of which radar rays 150 are reflected by the reflective agent 140. The reflective agent 140 is configured in the form of a sawtooth profile or configured in a stepped manner, respectively, such that the part-regions of the surface of the reflective agent 140 are at all times inclined in relation to the plane of main extent 160 of the cladding board 110. The reflective agent 140 alternatively comprises a woven fabric (gauze) and/or a carbon-fiber reinforced plastics-material insert (GRP). In order for the cladding board 110 to nevertheless be able to be configured as thin as possible along a direction that is perpendicular to the plane of main extent 160, the reflective agent 140 is constructed from a plurality of first and second reflective inclines 170, 180 which are disposed in an alternating manner along a direction of main extent 190 of the reflective agent 140 that is parallel with the plane of main extent 160. Herein, a first angle 200 is in each case configured between the plane of main extent 160 and the first reflective incline 170, and in each case a second angle 210 is configured between the plane of main extent 160 and the second reflective incline 180, wherein the first angle 200 is at all times smaller than the second angle 210. Furthermore, the face of the second reflective incline 180 is at all times smaller than the face of the first reflective incline 170. The reflective inclines 170, 180 which are inclined in relation to the plane of main extent 160 ensure that incident radar rays 150 that impact the reflective agent 140 along a direction of incidence that is substantially perpendicular are reflected by the reflective agent 140 in an outgoing direction that deviates from the antiparallel direction of incidence. In other words, radar rays 150 which are emitted by a radar source 220 and impact the cladding board 110 perpendicularly, are not reflected in a frontal manner back to the radar source 220 but are directed by the reflective agent 140 in other spatial directions having directional proportions that are parallel with the plane of main extent 160. This has the advantage that a radar apparatus that is connected to the radar source 220 receives a comparatively small radar echo, impeding the detection by radar. The effective radar cross section (RCS) is thus significantly reduced.

REFERENCE SIGNS

10 Container
20 Floor
30 Ceiling
40 Side wall
42 Folding joint
50 Post element
62 Upper door leaf
64 Lower door leaf
70 Crank
80 Threaded spindle
82 Drive
110 Cladding board
120 Cover layer
130 Core
140 Reflective agent
150 Radar rays
160 Plane of main extent
170 Reflective incline
180 Reflective incline
190 Direction of main extent
200 First angle
210 Second angle
220 Radar source

What is claimed is:

1. A container comprising:

a floor;

a ceiling;

a first side wall that includes a first cladding board that is permeable to radar rays and reduces an effective radar cross section of the container, the first cladding board having a reflective agent that reflects radar rays, wherein the reflective agent is embedded in the first cladding board and is aligned to be at least partially inclined relative to a plane of a main extent of the first cladding board;

a second side wall;

a first end wall; and a second end wall, wherein the first side wall and the second side wall in a longitudinal direction of the container mid-height between the floor and the ceiling are foldable inward into an interior of the container.

2. The container of claim 1 wherein the first side wall, the second side wall, the first end wall, and the second end wall are formed from a container wall for reducing the effective radar cross section of the container.

3. The container of claim 1 wherein the second side wall includes a second cladding board that is permeable to radar rays and reduces the effective radar cross section of the container, the second cladding board having a reflective agent that reflects radar rays, wherein the reflective agent of the second cladding board is embedded in the second cladding board and is aligned to be at least partially inclined relative to a plane of a main extent of the second cladding board.

4. The container of claim 3 wherein the first end wall includes a third cladding board that is permeable to radar rays and reduces the effective radar cross section of the container, the third cladding board having a reflective agent that reflects radar rays, wherein the reflective agent of the third cladding board is embedded in the third cladding board and is aligned to be at least partially inclined relative to a plane of a main extent of the third cladding board.

5. The container of claim 4 wherein the second end wall includes a fourth cladding board that is permeable to radar rays and reduces the effective radar cross section of the container, the fourth cladding board having a reflective agent that reflects radar rays, wherein the reflective agent of the fourth cladding board is embedded in the fourth cladding board and is aligned to be at least partially inclined relative to a plane of a main extent of the fourth cladding board.

6. The container of claim 1 wherein the first end wall comprises a first door that is double-leafed with a first door leaf and a second door leaf, wherein the first door is foldable inward into the interior of the container, wherein the first door leaf includes a first upper door leaf and a first lower door leaf, wherein the second door leaf includes a second upper door leaf and a second lower door leaf, wherein the first upper door leaf, the first lower door leaf, the second upper door leaf, and the second lower door leaf extend across half of a height between the floor and the ceiling.

7. The container of claim 6 wherein the first upper door leaf and the first lower door leaf are connectable, wherein the second upper door leaf and the second lower door leaf are connectable.

8. The container of claim 6 wherein the first door of the first end wall is foldable inward into the interior of the container, wherein the first door of the first end wall can be opened outward.

9. The container of claim 1 wherein in an unfolded state the container is configured as a cuboid, the container further comprising post elements, which in the unfolded state are disposed on edges of the cuboid and connect the ceiling and the floor in a force-fitting manner.

10. The container of claim 9 wherein the post elements are connected to the floor by way of at least two threaded spindles, wherein by rotating the at least two threaded spindles the post elements are alignable so as to be parallel with the floor.

11. The container of claim 10 wherein the at least two spindles are driven manually, electrically, hydraulically, or pneumatically.

12. The container of claim 1 wherein the container complies with ISO 668.

13. The container of claim 12 wherein the container is a 20 feet container according to ISO 668.

14. The container of claim 1 wherein the container is secured to withstand ballistics.

15. The container of claim 1 wherein the reflective agent has a sawtooth profile.

* * * * *